US007640771B2

(12) United States Patent
Fechtel et al.

(10) Patent No.: US 7,640,771 B2
(45) Date of Patent: Jan. 5, 2010

(54) SUDS CONTAINER FOR A WASHING MACHINE AND METHOD FOR MAKING A SUDS CONTAINER

(75) Inventors: Benedikt Fechtel, Rheda-Wiedenbrueck (DE); Matthias Hollenhorst, Lippstadt (DE); Andreas Kratzsch, Bielefeld (DE); Antje Nieder, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 512 days.

(21) Appl. No.: 11/533,997

(22) Filed: Sep. 21, 2006

(65) Prior Publication Data

US 2007/0062225 A1 Mar. 22, 2007

(30) Foreign Application Priority Data

Sep. 21, 2005 (DE) ..... 10 2005 045 178

(51) Int. Cl.
*D06F 39/12* (2006.01)

(52) U.S. Cl. ..... 68/3 R; 68/232; 68/142

(58) Field of Classification Search ..... 134/184, 134/198; 264/252; 68/3 R, 232, 142
See application file for complete search history.

(56) References Cited

U.S. PATENT DOCUMENTS 3,098,582 A * 7/1963 Martin ..... 220/613
3,293,860 A * 12/1966 Stedfeld ..... 60/263
3,508,677 A * 4/1970 Laibson et al. ..... 220/590
3,655,468 A * 4/1972 Bastone et al. ..... 156/62.2
4,012,266 A * 3/1977 Magee et al. ..... 156/173
2005/0092034 A1 * 5/2005 Hollenhorst et al. ..... 68/275
2007/0068199 A1 3/2007 Dahlmann et al.

FOREIGN PATENT DOCUMENTS

| | | | |
|---|---|---|---|
| DE | 1918222 | | 6/1965 |
| DE | 27 06 899 | * | 8/1978 |
| DE | 8510620 | | 5/1986 |
| DE | 10345848 | | 4/2005 |
| DE | 102005018190 | | 8/2006 |
| EP | 1240376 | | 9/2002 |
| EP | 1528136 | | 5/2005 |
| GB | 2173868 | | 10/1986 |
| GB | 2333300 | | 7/1999 |
| JP | 54-085273 | * | 7/1979 |
| JP | 10-204193 | * | 8/1998 |
| KR | 2004049367 | * | 6/2004 |
| WO | WO 98/20274 | * | 5/1998 |

OTHER PUBLICATIONS

European Patent Office 0 744 274 Nov. 1996.*

* cited by examiner

*Primary Examiner*—Frankie L Stinson
(74) *Attorney, Agent, or Firm*—Darby & Darby

(57) ABSTRACT

A suds container for a washing machine includes a cylindrical vessel surrounding a drum of the washing machine, the cylindrical vessel including a cylindrical wall and a front wall. A metallic hub for a drive shaft for the drum is integrated into a plastic compound of the front wall. Reinforcing plastic fiber strands are integrated into the plastic compound. The fiber strands extend from the hub outward toward the outer circumference of the front wall.

9 Claims, 5 Drawing Sheets

SUDS CONTAINER FOR A WASHING MACHINE AND METHOD FOR MAKING A SUDS CONTAINER

Priority is claimed to German patent application DE 10 2005 045 178.0, filed Sep. 21, 2005, which is hereby incorporated by reference herein.

The invention relates to a suds container made of plastic for a washing machine, comprising a cylindrical vessel that surrounds the drum, whereby a metallic hub to receive a drive shaft for the drum is integrated into the plastic compound in one of the front walls. The invention also relates to a method for the production of such a suds container made of plastic.

BACKGROUND

Suds containers made of plastic for washing machines are known, said containers being in the form of a cylindrical vessel that surrounds the drum. Here, a metallic bearing block with a hub to receive a drive shaft for the drum is integrated into the plastic compound in one of the front walls. The encapsulation of the metallic bearing block by injection molding gives rise to considerable intrinsic stresses in the suds container resulting from the fact that the plastic cools off from the hardening temperature down to room temperature, shrinking in the process. Forces caused by the different shrinkage behavior of the plastic in comparison to the metal part exert such a strong effect on the bearing block that the suds container can become deformed, at least in some areas. This has a detrimental impact on the homogeneity of the suds container so that stress peaks can give rise to hairline cracks that are particularly responsible for greatly reducing the service life of a suds container created in this manner.

EP 1 240 376 B1 describes a suds container, and in this embodiment, a so-called stand support part is laid into the injection mold. Then the part is encapsulated in the mold with an especially fiberglass-reinforced plastic in such a way that the metallic part is embedded at least almost completely into the material of the front surface. When such an injection-molded part cools off, the different materials give rise to shrinkage stresses that can cause the above-mentioned hairline cracks in the material.

Another technique known for the production of a suds container made of plastic is described in GB 2 333 300 A, in which radial ribs are formed around the receiving area of the hub, which is likewise integrated into the plastic compound so that said ribs, together with rings, form an additionally reinforcing truss-like profile in the bearing block area.

The problem that arises despite the use of a fiberglass-reinforced plastic is that these hairline cracks nevertheless occur, particularly in the integration area of the metallic bearing block or of the hub, especially at the boundary between the plastic and the metal, which translates into a shortened service life for the suds container. Moreover, the price of fiberglass-reinforced plastics for suds containers is very high. Inexpensive, non-reinforced plastics are not suitable for use under the requisite mechanical and thermal loads. In addition to this main problem, reinforced plastics also entail drawbacks, namely, the fact that they display anisotropic material behavior because the fiber-matrix coupling is extremely problematic because of the very short fibers and the different orientation of the fibers. Aside from the shortened service life, the mechanical strength and the thermal strength are likewise limited.

SUMMARY

Therefore, an object of the present invention is to provide a suds container for a washing machine, having at least one integrated metallic hub that is improved in terms of its service life as well as its mechanical and thermal strength. It another, alternative, object of the present invention to provide a method for the production of an improved suds container.

In an embodiment, the present invention provides a suds container for a washing machine. The suds machine includes a cylindrical vessel configured to receive a drum of the washing machine, the cylindrical vessel including a cylindrical wall and a front wall. A metallic hub configured to receive a drive shaft for the drum is integrated into a first plastic material compound of the front wall. A plurality of reinforcing fiber strands including a second plastic material are integrated into the first plastic material compound in respective areas thereof. The fiber strands extend from the hub outward toward an outer circumference of the front wall.

BRIEF DESCRIPTION OF THE DRAWINGS

A number of embodiments of the invention will be explained in greater detail with reference to the drawings. The drawings show the following.

DETAILED DESCRIPTION

Figure 1:
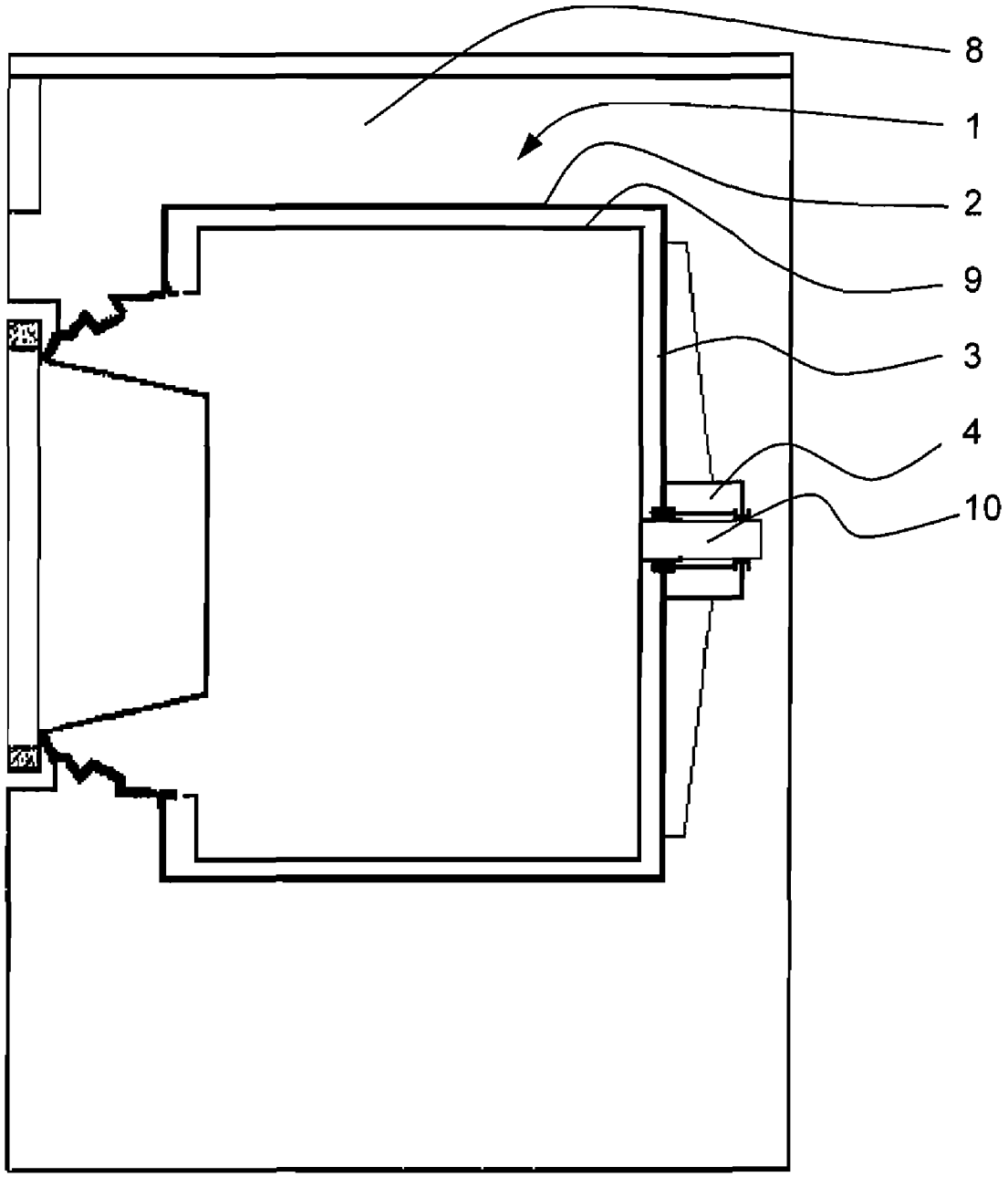
FIG. 1 a schematic depiction of a washing machine.

In an embodiment, the present invention provides a method for making a suds container for a washing machine, the suds container including: a cylindrical vessel configured to receive a drum of the washing machine, the cylindrical vessel including a cylindrical wall and a front wall; and a metallic hub configured to receive a drive shaft for the drum, the metallic hub being integrated into a first plastic material compound of the front wall; wherein a plurality of reinforcing fiber strands including a second plastic material are integrated into the first plastic material compound in respective areas thereof, the fiber strands extending from the hub outward toward an outer circumference of the front wall. The method includes: disposing the hub in an injection mold; disposing the fiber strands in the mold by, using a winding device, winding at least one filament about the hub and about a plurality of holding elements disposed in the mold; closing the mold; and then feeding the plastic material compound into the mold via an inlet.

In another embodiment, the present invention provides a method for making a suds container for a washing machine, the suds container including: a cylindrical vessel configured to receive a drum of the washing machine, the cylindrical vessel including a cylindrical wall and a front wall; and a metallic hub configured to receive a drive shaft for the drum, the metallic hub being integrated into a first plastic material compound of the front wall; wherein a plurality of reinforcing fiber strands including a second plastic material are integrated into the first plastic material compound in respective areas thereof, the fiber strands extending from the hub outward toward an outer circumference of the front wall. The method includes: disposing the hub in a holding device; disposing the fiber strands on the holding device by, using a winding device, winding at least one filament about the hub and about a plurality of holding elements disposed on the holding device; disposing the hub, together with the fiber strands, in a mold; closing the mold; and then feeding the plastic material compound into the mold via an inlet.

A metallic hub to receive a drive shaft for the drum is integrated into the plastic compound in the front wall of the suds container according to the invention. For reinforcement purposes, reinforcing fiber strands are integrated into the plastic compound, at least in certain areas. In order to improve the strength in the hub area, the fiber strands are arranged in such a way that they extend from the hub towards the front wall. As a result, the hub is anchored, so to speak, in the plastic compound of the front wall. An approximately uniform application of force from the hub into the container wall, especially the front wall, is likewise achieved, while force peaks are avoided. The described invention also has the advantage that the suds container can be injection-molded using non-reinforced plastic and is only stiffened locally. The fiber strands are made of plastic, preferably of fiberglass-plastic fibers or fiberglass-plastic filaments. If high strength or a special extensibility is required, the fiber strands can be made of polyester fibers or polyester filaments, Kevlar fibers or Kevlar filaments, or carbon fibers or carbon filaments in alternative embodiments. A combination of fibers or filaments is likewise conceivable.

In an embodiment of the invention, the fiber strands in the front wall extend from the hub essentially radially towards the outside. As a result, the application of force can be distributed over a very large area of the front wall.

In order to achieve a good connection of the fiber strands to the hub, the fiber strands are arranged around at least one section of the outer circumference of the hub. In this context, it is advantageous to wind the fiber strands at least in sections around the hub.

In an embodiment, the fiber strands are configured in such a way that they extend beyond the front wall into the area of the cylindrical container, especially into the edge area. This arrangement serves to reinforce the cylindrical container or the connection between the front wall and the wall of the jacket. The forces acting upon the container wall are distributed over a larger area, as a result of which the service life of the container is greatly improved.

In an embodiment, the fiber strands are configured like bands. Here, they are wound around the hub in such a way that, each time, two bands that lie adjacent on the hub start from the hub and extend towards the outside so as to converge with each other. They meet at their outer ends. In an embodiment, the bands are wound out of at least one filament, the outer ends being configured as reversing points for the winding. This way, adjacent bands are joined to each other at their outer ends in a practical manner.

In an embodiment, the band-like fiber strands are configured as an upper band and a lower band.

Here, the fiber strands are oriented in such a way that they are oriented on the front wall in a manner that corresponds to the occurring stress lines. Advantageously, the fiber strands are oriented in a star formation, the hub constituting the center point, while the tips are formed by the outer ends of the band-like fiber strands. This arrangement makes the band-like fiber strands suitable to absorb tensile stresses.

For purposes of holding the bearing of the washing drum, the hub may be fastened to the front wall in a very sturdy fashion. The hub is firmly connected in the front wall or in the suds container by configuring the band-like fiber strands as an upper band and a lower band. In the joining area to the hub, the upper band is arranged at a distance from the lower band, the latter being arranged close to the plane of the front wall. The upper band and the lower band extend in a convergent manner in the plane of the front wall, so that they meet at their outer ends. Owing to this arrangement, a broad support is provided for the hub in this area of the front wall.

In an embodiment, the bands are each formed by at least one filament, for instance, through weaving or multiple winding of the filament.

In an advantageous manner, the fiber strands may be joined to each other at their outer ends, thus even further increasing the stability.

Additionally, the bottom structure can be stiffened by additional ribs.

This improved fiber-matrix coupling allows the use of cheaper, non-reinforced plastic materials since the fiber strands or fiber batts bring about a systematic strengthening of the highly stressed areas in a manner that is appropriate for the distribution of forces.

From a material and cost standpoint, it is advisable for components such as a suds container made of plastic to be systematically reinforced as a function of the loads that occur during washing or spinning cycles. Reinforcements in the form of admixed short glass fibers often entail undesired side effects such as, for instance, pronounced anisotropy and poor fiber-matrix coupling. The described invention, in contrast, has the advantage that the suds container can be injection-molded using non-reinforced plastic and only needs to be stiffened locally. This is achieved with fiber strands or fiber batts that are placed into the mold prior to the injection-molding process. This can be done in various ways. On the one hand, the batt can be wound up directly in the mold by means of a robot. On the other hand, the desired batt shape can be created on a holding device and then transferred to the injection mold by means of suitable grippers. Consequently, appropriate holding pins around which the batt can be wound have to be provided in the mold and/or on the holding device. It can also be advantageous to fasten the batt prior to the operation, for instance, by means of spray adhesive or similar, thereby simplifying the handling involved during the insertion into the mold.

When it comes to the method for the production of a suds container made of plastic for a washing machine, comprising a cylindrical vessel that surrounds the drum, whereby a metallic hub to receive a drive shaft for the drum is integrated into the plastic compound in one of the front walls, it is advantageous to affix the hub in an injection mold in a first step, to form the fiber strands inside the mold in a second step—whereby a winding device winds and affixes at least one filament around the hub and around holding elements arranged in the mold—and in a third step, to feed the plastic compound into the mold via an inlet after the mold has been closed. This method has the advantage that no other devices are needed for the production. During and after the production of the fiber strands, they are in the position appropriate for the injection molding.

In an embodiment, the fiber strands can be wound or woven on a separate holding device. In a first step, the hub is affixed to the holding device. In a second step, the fiber strands are formed by winding or weaving on the holding device. A winding or weaving device winds the single filament around the hub and subsequently around pin-shaped holding elements arranged on or attached to the holding device. In a third step, the hub is laid and affixed in the mold together with the fiber strands. This can be done with a gripper that lays the hub and the fiber strands into the mold in accordance with their shape and position. In a fourth step, after the mold has been closed, the plastic compound is fed into the mold via an inlet. In this manner, the fiber strands can be provided or produced independently of the injection-molding process.

In such a case, it is advantageous to stabilize or affix the shape that the winding or weaving has imparted to the fiber strands. This can be done by impregnating the fiber strands in a bath containing a fixative or by spraying them with such a fixing agent. An adhesive or a synthetic resin can be employed as the fixative.

FIG. 1 shows a washing machine 8 with a suds container 1 in a sectional side view. The suds container 1 consists of at least one cylindrical jacket 2 surrounding a drum 9. The cylindrical jacket 2 is closed by at least one front wall 3. A hub 4 is integrated into the front wall 3 and this hub 4 receives the drive shaft 10 for the drum 9.

Figure 2:
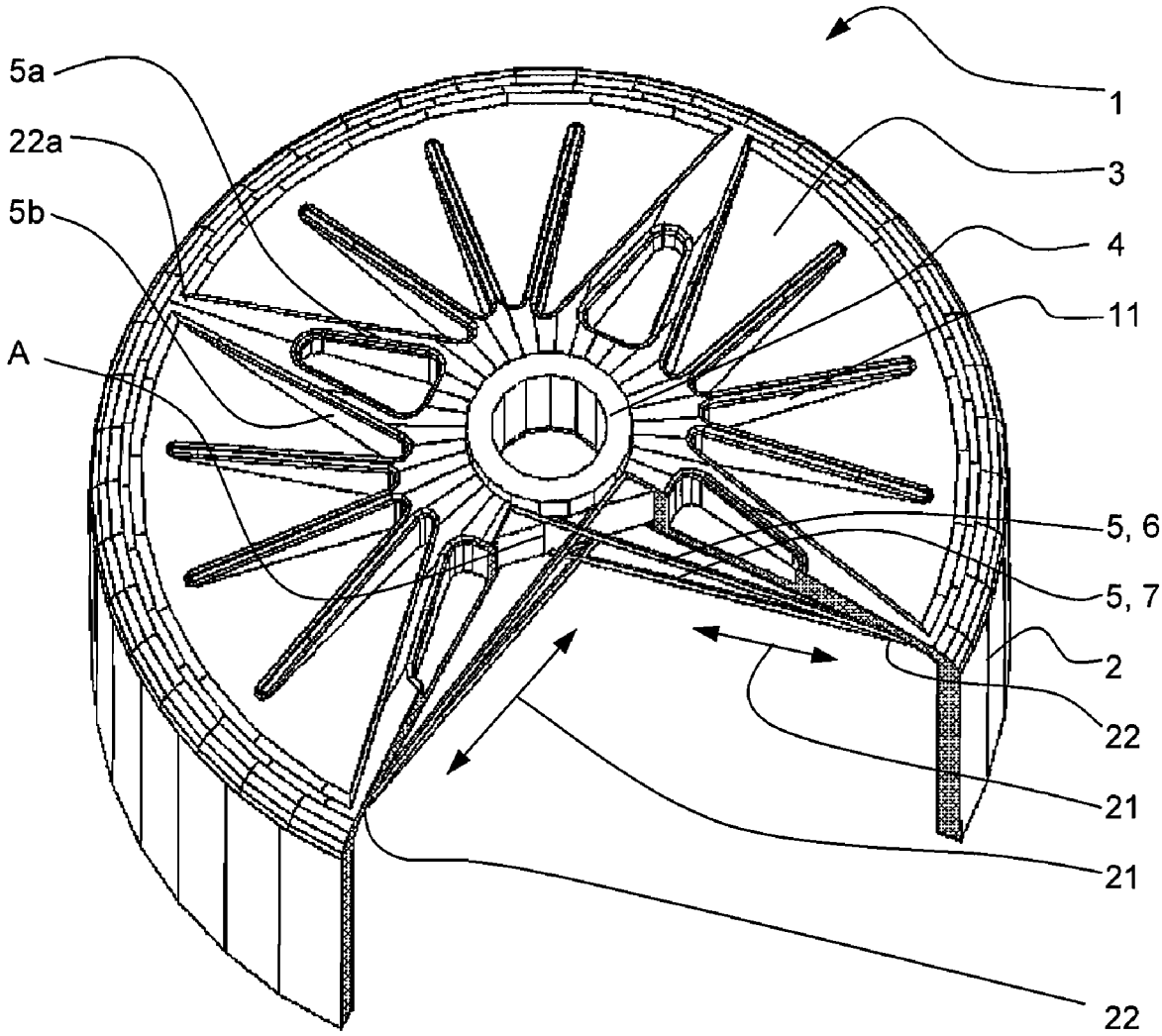
FIG. 2 a perspective depiction of a suds container, with a cutout.

FIG. 2 shows the suds container 1 made of plastic in a perspective depiction in which a cutout clearly shows the fiber strands 5. The hub 4 is integrated into the middle of the front wall 3. Fiber strands 5 are laid around at least part of the circumference of the hub 4 and they extend away from the hub 4 towards the radially external area of the front wall 3. The fiber strand configured as the lower band 7 runs essentially in the plane of the front wall 3. The upper band 6 is arranged on the hub 4 at an axial distance A—relative to the hub 4—from the lower band 7. The radial extension of the upper band 6 runs towards the lower band 7 and converges with it at its outer end 22. Starting from the hub 4, the band-like fiber strands 5 run essentially in correspondence with the occurring forces 21. As a result, the hub 4 is well supported in the front wall 3. The formation of several bands 6, 7 creates a star-shaped structure. Both the lower band 7 and the upper band 6 are completely embedded in or encapsulated by the plastic of the front wall 3 or of the edge area of the cylindrical body 2. It can be seen in the top view that, in each case, two adjacent fiber strands 5*a* and 5*b* lie at a distance from each other on the hub 4. The ends 22*a* of these fiber strands 5*a*, 5*b* are pointed, and the combination of all of the fiber strands 5 creates a star-shaped structure. The ends 22 can also lie in the jacket area 2 of the suds container 1, as a result of which the connection between the front wall 3 and the jacket 2 is reinforced since the application of force from the hub 4 into the suds container 2 is distributed over a large surface area. The main load is introduced into the front wall 3 via the hub 4 and via the fiber strands 5, so that, in particular, stress on the plastic is relieved. This arrangement allows the use of cheaper plastic compounds that are not so high-strength.

Additional ribs 11 are formed in the front wall for purposes of reinforcing the suds container 1. These ribs 11 extend essentially radially away from the hub 4.

Figure 3:
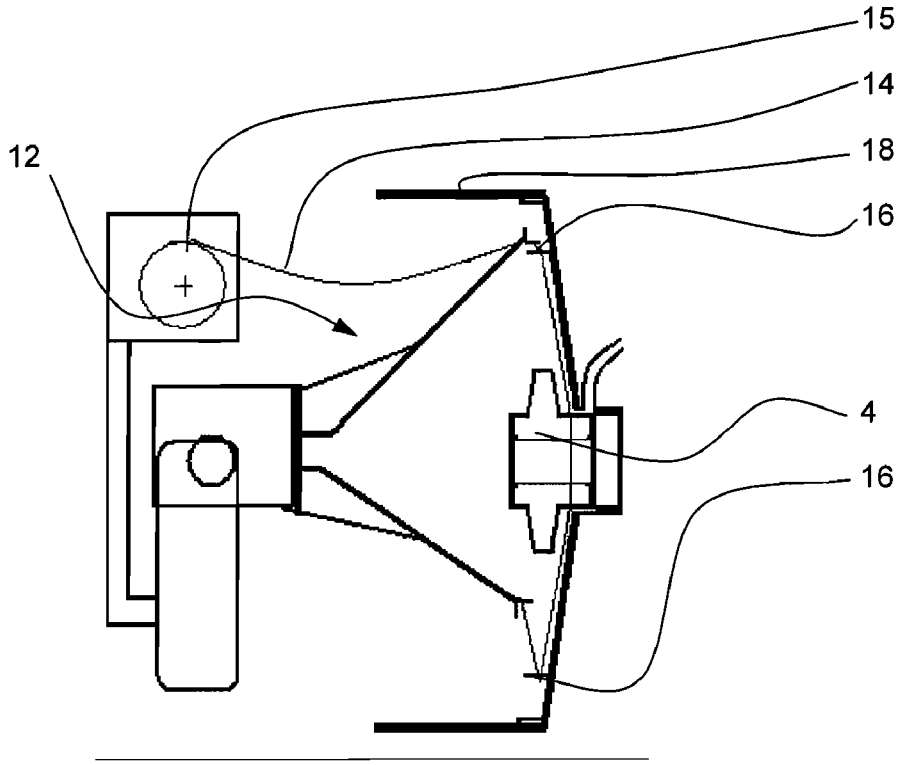
FIGS. 3-5 a schematic depiction of the production of the suds container.
Figure 4:
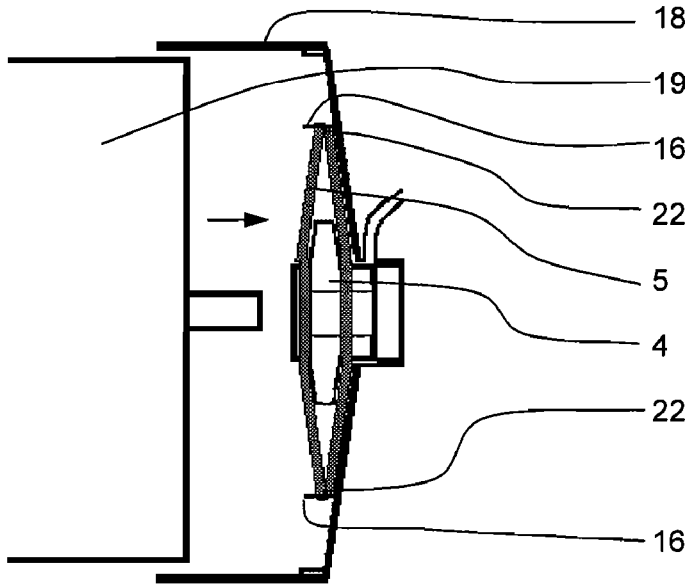
Figure 5:
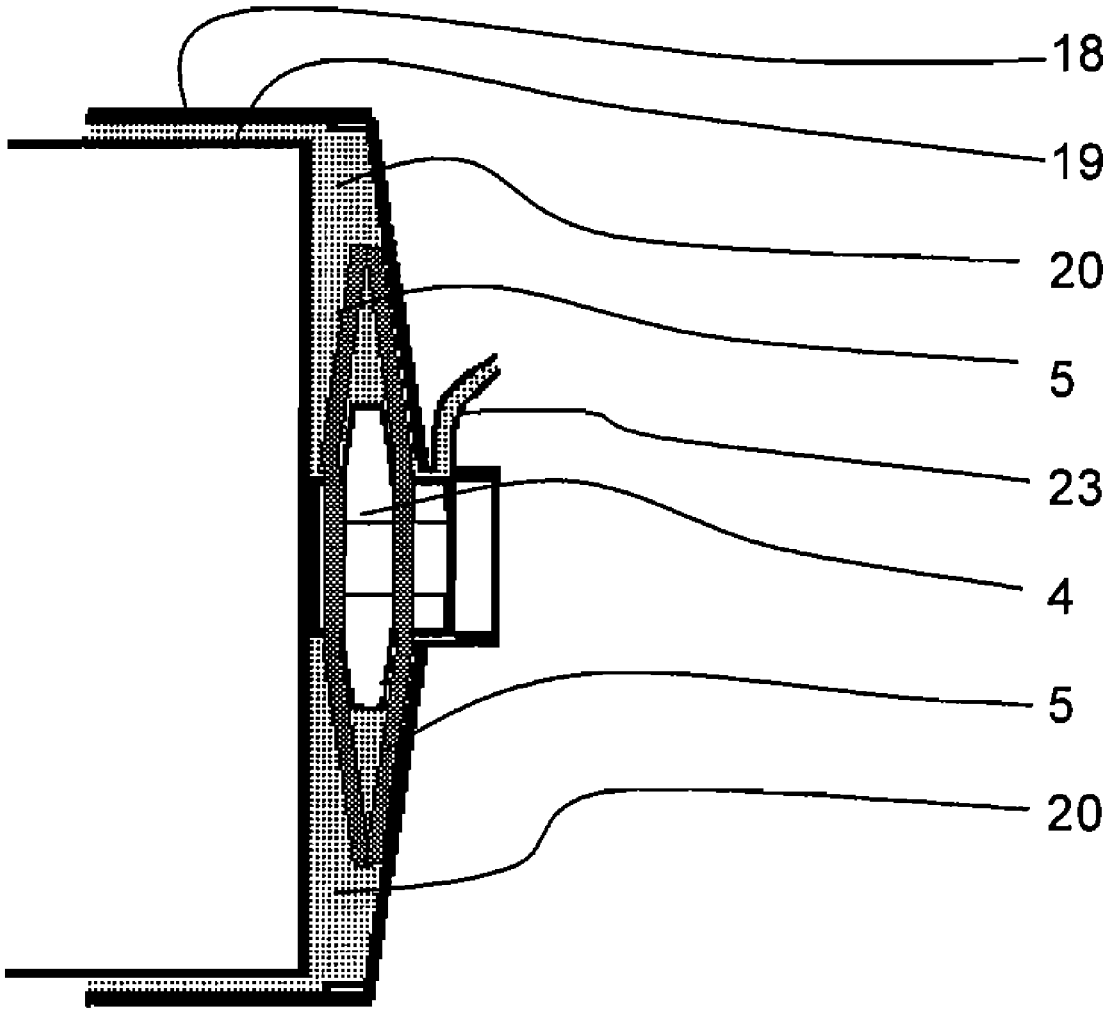

The method for the production of the suds container 1 made of plastic is schematically shown in FIGS. 3, 4 and 5. According to FIG. 3, the hub 4 is laid into and affixed to the injection mold in a first step. The mold 18 contains holding elements 16 which, as depicted in FIG. 4, form the outer end points 22 of the fiber strands 5. A winding device 12 then unwinds a plastic filament 14 from a filament bobbin 15 and lays this filament 14 several times at least partially around the hub 4 and around the holding elements 16 fastened inside the mold 18. According to FIG. 4, the winding procedure is completed as soon as the entire structure consisting of fiber strands 5 has been wound or woven between the hub 4 and the holding elements 16 in the mold 18. The mold 18 is closed by an internal part 19 in the direction indicated by the arrow, after which the winding device 12 is removed from the mold 18.

FIG. 5 illustrates the injection-molding procedure. In the mold 18 closed by the internal part 19, essentially liquid or viscous plastic compound 20 is fed into the mold 18 via an inlet 23. The essentially liquid plastic 20 is fed into the mold 18 until the hollow space between the inner part 19 and the mold 18 is completely filled. In this state, the hub 4 and the fiber strands 5 joined to the hub 4 are integrated into the plastic compound 20. The holding elements 16 can be removed from the mold 18 during or after the injection molding procedure. However, it is likewise possible to leave the pin-shaped holding elements 16 in the mold 18, so that they stay in the front wall 3, at least until after the hardening. In an alternative embodiment, the holding elements 16 can also remain permanently in the front wall 3, as a result of which the fastening of the ends 22 of the fiber strands 5 to the front wall 3 is further enhanced.

Figure 6:
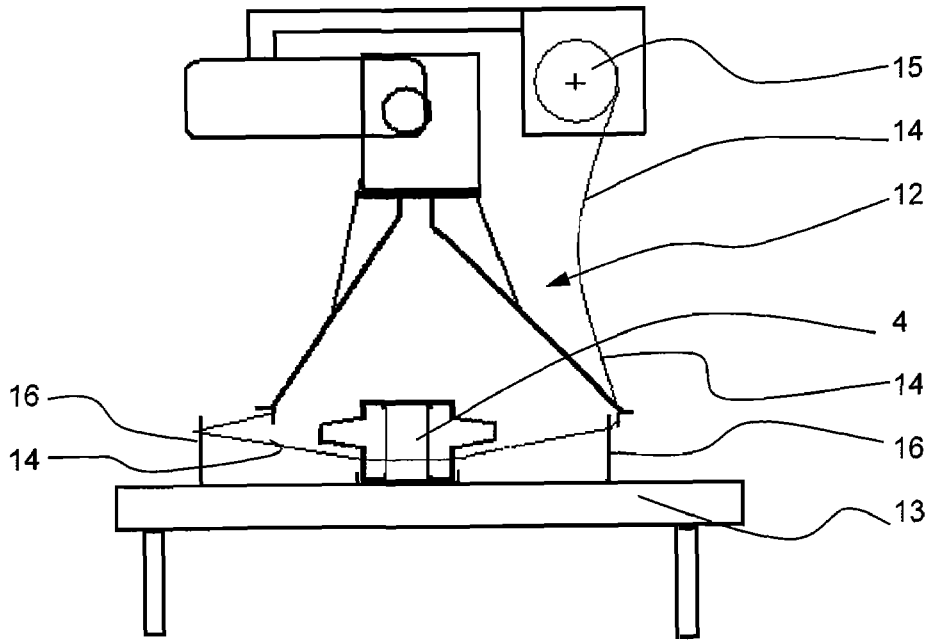
FIGS. 6, 7 a schematic depiction of an alternative embodiment of the production.
Figure 7:
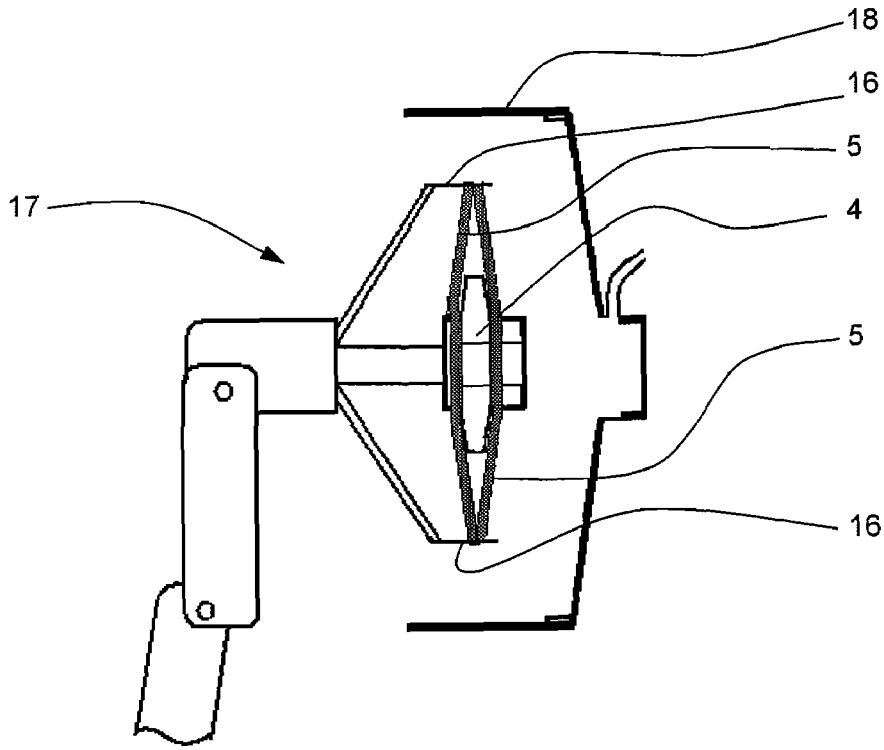

FIGS. 6 and 7 show a schematic depiction of an alternative embodiment for the production of the fiber strands 5. According to FIG. 6, the hub 4 is fastened to a holding device 13 or laid so as to be stationary. The holding device 13 has holding elements 16 that form the outer end points 22 of the fiber strands 5. A winding device 12 unwinds a plastic filament 14 from a filament bobbin 15 and lays this filament 14 multiple times at least partially around the hub 4 and around the holding elements 16 positioned on the holding device 13. The winding procedure is completed once the entire structure consisting of fiber strands 5 and the holding elements 16 has been wound or woven onto the holding device 13. In this context, it can be advantageous to solidify the shape of the fiber strands 5 by using a fixative (not shown here), for instance, a spray adhesive, or else by impregnating them with a fixing agent. FIG. 7 shows by way of example that a gripper 17 grasps the structure consisting of the hub 4 and the fiber strands 5 and transports it from the holding device 13 into the mold 18. In this example, the gripper 17 also takes along the holding elements 16 so that the structure consisting of the hub 4 and the fiber strands 5 prepared on the holding device 13 retains its shape. After the hub 4 with the fiber strands 5 wound around it has been laid into the mold 18, the subsequent steps are carried out, as shown and described in FIGS. 4 and 5.

The scope of the present invention is not limited to the exemplary embodiments described herein; reference should be had to the appended claims.

What is claimed is:

1. A suds container for a washing machine, comprising:

a cylindrical vessel configured to receive a drum of the washing machine, the cylindrical vessel including a cylindrical wall and a front wall; and a metallic hub configured to receive a drive shaft for the drum, the metallic hub being integrated into a first plastic material compound of the front wall;

wherein a plurality of reinforcing fiber strands including a second plastic material are integrated into the first plastic material compound in respective areas thereof and wound around an outer circumference of the hub at least in sections, the fiber strands extending from the hub outward toward an outer circumference of the front wall, wherein the fiber strands include a configuration of a plurality of bands including an upper band and a lower band, a portion of the upper band being disposed at an axial distance from the lower band in a vicinity of the hub.

2. The suds container as recited in claim 1 wherein the first along the front wall and second fiber strands of the fiber strands extend towards a surface of the front wall.

3. The suds container as recited in claim 1 wherein the fiber strands extend substantially radially outward from the hub.

4. The suds container as recited in claim 1 wherein the fiber strands extend from the hub substantially radially beyond the front wall into respective areas of the cylindrical wall of the suds container.

5. The suds container as recited in claim 1 wherein the plurality of bands includes a first and a second band disposed adjacent each other an including respective outer ends, the first and second bands extending from the hub towards each other so as to converge at respective outer ends thereof.

6. The suds container as recited in claim 1 wherein the upper band and the lower band include respective outer ends and extend in a convergent manner so as to meet at the respective outer ends, the upper band extending towards a surface of the front wall and the lower band extending along the surface of the front wall.

7. The suds container as recited in claim 1 wherein the fiber strands are disposed substantially in a star formation corresponding to occurring stress lines.

8. The suds container as recited in claim 1 wherein each of the fiber bands include at least one respective filament.

9. The suds container as recited in claim 1 wherein the fiber strands include first and second fiber strands having respective ends joined to each other, the first and second fiber strands extending towards each other so as to converge at the respective ends.

* * * * *